United States Patent [19]

Brown

[11] 4,066,148

[45] Jan. 3, 1978

[54] HYDRAULICALLY-ACTUATABLE ELEVATOR SYSTEM

[75] Inventor: Richard L. Brown, Bellevue, Nebr.

[73] Assignee: Lo-Rise Elevator Company, Plattsmouth, Nebr.

[21] Appl. No.: 667,697

[22] Filed: Mar. 17, 1976

[51] Int. Cl.[2] ..... B66B 11/04

[52] U.S. Cl. ..... 187/17; 91/449

[58] Field of Search ..... 187/1 R, 17, 28, 29 A; 91/449, 454

[56] References Cited

U.S. PATENT DOCUMENTS

| | | | |
|---|---|---|---|
| 3,141,386 | 7/1964 | Loughridge | 91/449 X |
| 3,294,199 | 12/1966 | Jarvik | 187/1 R |
| 3,304,842 | 2/1967 | Shafer | 91/454 |
| 3,650,356 | 3/1972 | Brown | 187/17 |
| 3,738,455 | 6/1973 | Tintore | 187/15 |

*Primary Examiner*—John J. Love
*Assistant Examiner*—James L. Rowland
*Attorney, Agent, or Firm*—George R. Nimmer

[57] ABSTRACT

Generally described is a hydraulically-actuatable elevator system wherein the vertically reciprocatable cargo-carrying carrier member is suspended from a lofty superstructure by at least one hydraulically-actuatable elongate piston of the casing/plunger type. An electrically powered pump means, having a fluids reservoir co-movably mounted with the carrier, forceably introduces hydraulic fluid along a primary-line into the piston casing thereby decreasing the piston overall length causing the carrier to ascend, and controlled withdrawal of hydraulic fluid from the piston to the reservoir through a secondary-line (provided with an electrically governable checkvalve) allowing the weighty carrier member to descend. An emergency-line communicating between the piston casing and reservoir parallels the secondary-line and bypasses the pump means and the checkvalve and has a normally-closed barrier which is mechanically openable by a carrier passenger whereby the carrier can be made to descend in the contingency of electrical power failure.

9 Claims, 7 Drawing Figures

HYDRAULICALLY-ACTUATABLE ELEVATOR SYSTEM

The elevator system and the objectives of the present invention are generally similar to those of my earlier U.S. Pat. No. 3,650,356 (Mar. 21, 1972).

As is apparent from my earlier U.S. Pat. No. 3,650,356, an electrically powered pump means and an electrically governable check-valve are almost invariably required for causing the hydraulically-actuatable elevator to ascend and to descend. Thus, a sudden failure of electrical power would instantly disable the elevator, whereupon the passengers might find themselves trapped between floorlevels and hence without practical egress from the disabled elevator carrier member.

It is accordingly the general objective of the present invention to provide capability for the hydraulically-actuatable elevator system to descend to a floor-level therebeneath, whenever there is a power failure to the electrical check-valve, thus permitting easy and safe passenger egress thereat. It is an ancillary generally specified objective to provide such emergency descent capability through simple and reliable manual control by an elevator passenger, and with the optional provision for tamper-proof shielding means to shield the manual control from vandals and pranksters, and until such time as a bona fide electrical power failure has actually occurred.

With the above and other objects and advantages in view, which will become more apparent as this description proceeds, the hydraulically actuatable elevator system herein described is based upon the concepts described under U.S. Pat. No. 3,650,356, and to which is added emergency-hose means for bypassing the primary-hose extending from the reservoir through a pump means and an electrically governable check-valve, the emergency-hose having a normally-closed barrier which is manually openable by an elevator passenger whenever there is electrical power failure to the check-valve thereby allowing the elevator carrier to safely descend to a lower floor-level, tamper proof shield means being an optional feature to prevent malicious and unauthorized tampering with the normally closed emergency-hose barrier unless a bona fide electrical power failure has occurred.

In the drawing, wherein like character refer to like parts in the several views, and in which.

Figure 3:
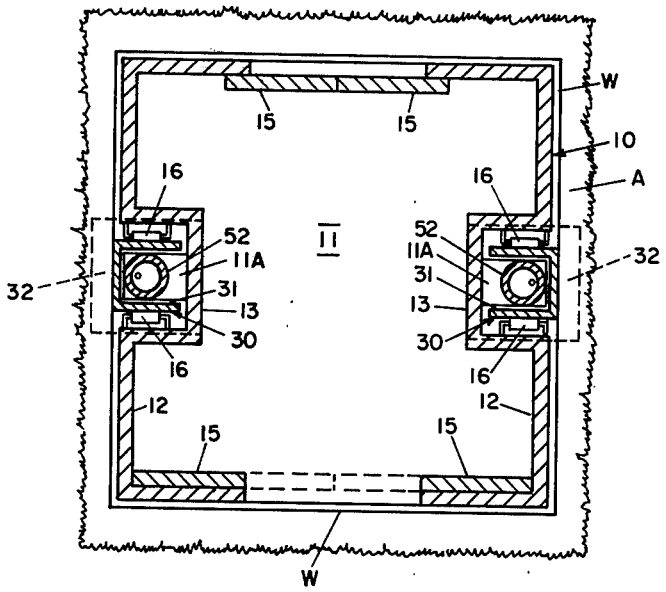
FIG. 3 is a sectional plan view taken along line 3—3 of FIG. 2.
Figure 5:
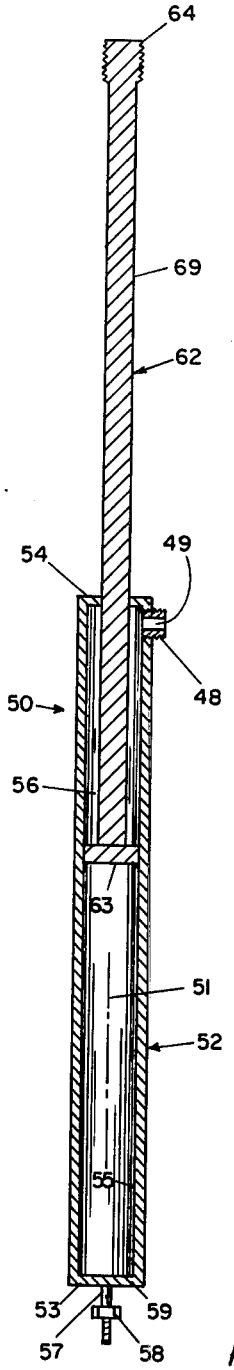
Figure 4:
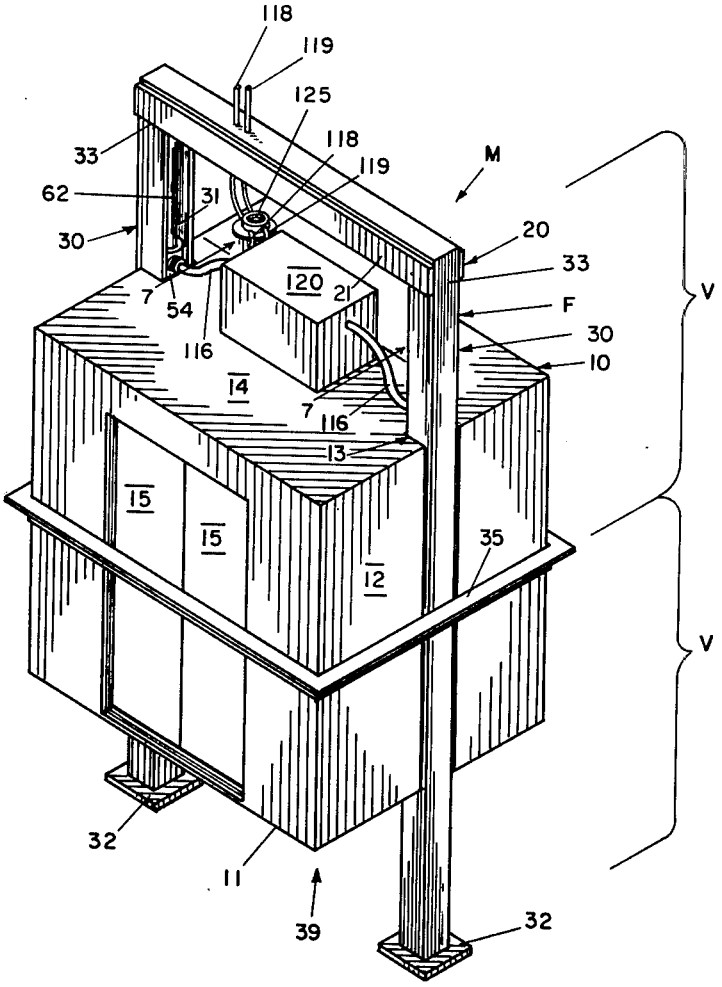
FIG. 4 is a perspective elevational view of the system of FIGS. 2 and 3, particularly showing the desireable modular-like structural characteristics thereof whereby the elevator system might be employed within the lofty internal wellway "W", or with equal facility upon patio "P" located alongside an external upright wall of typical building structure "S"
Figure 6:
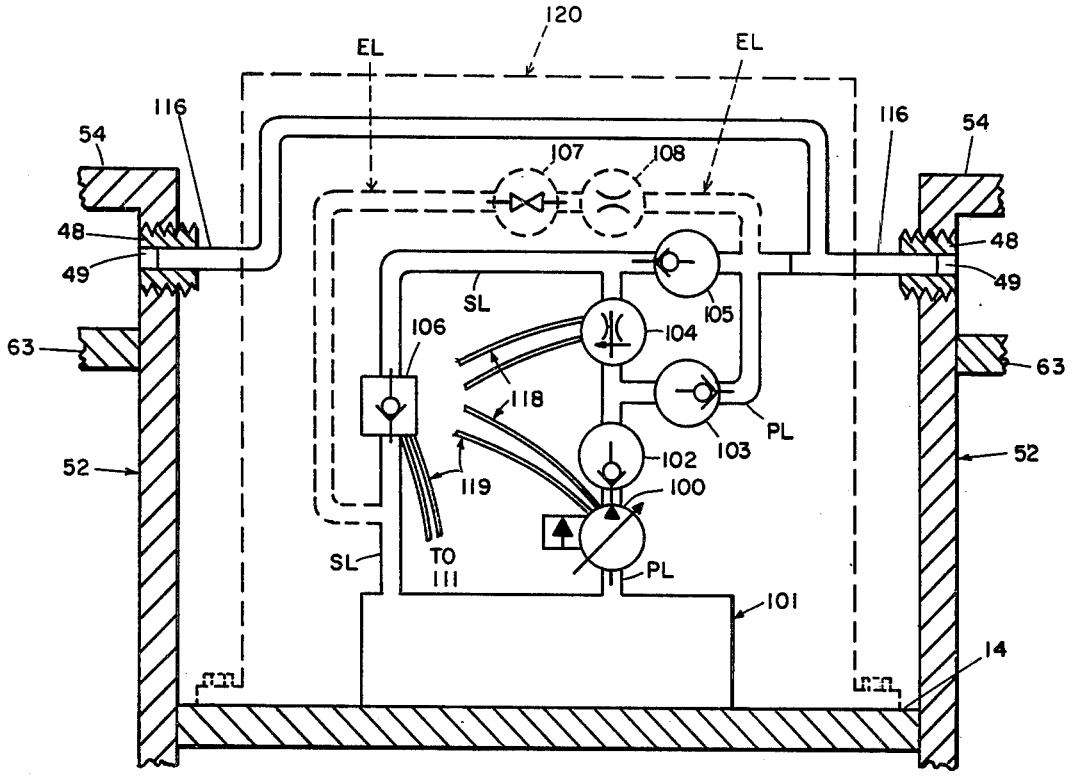
Figure 7:
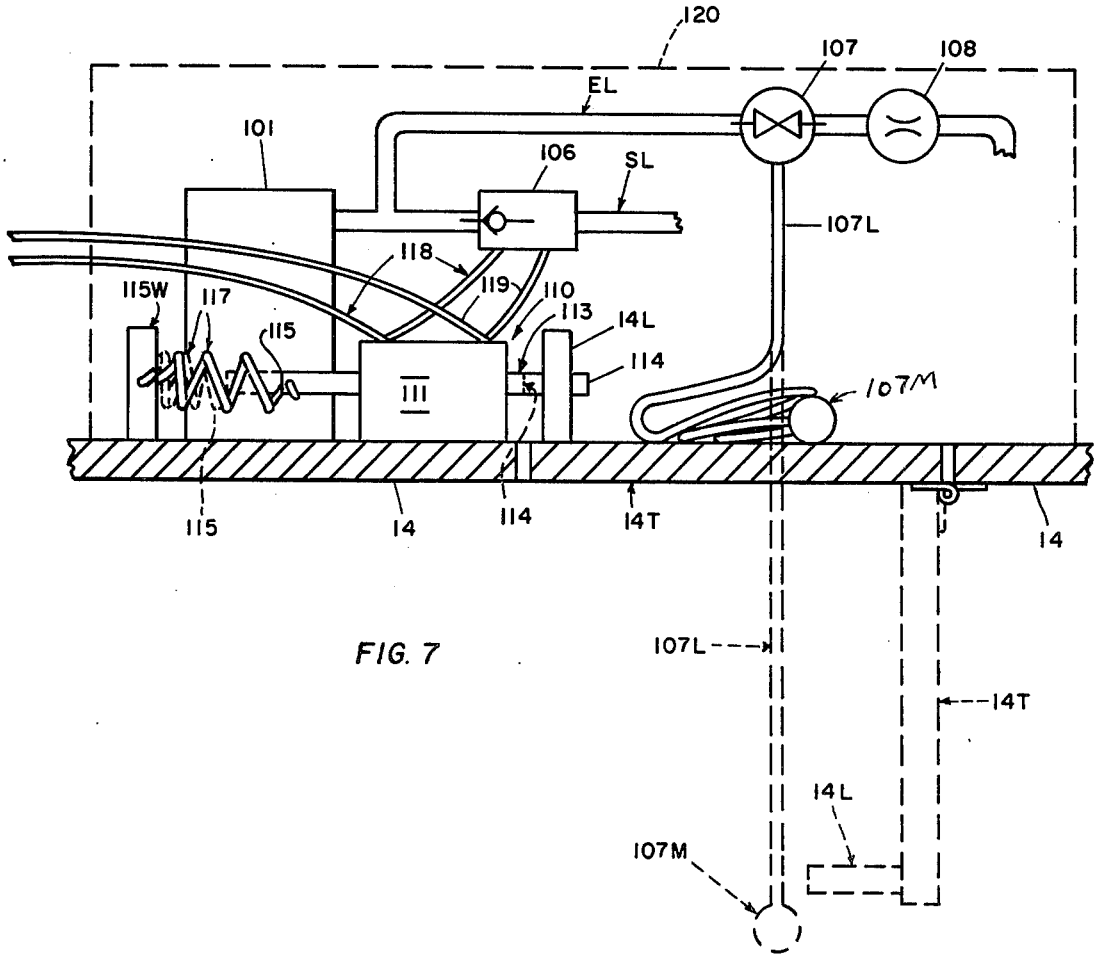

FIG, 5 5 is a detail sectional elevational view of the hydraulically-actuatable piston component of FIGS. 1-4;

FIG. 6 is a schematic view of the preferred hydraulic network for the hydraulically-actuatable elevator system;

FIG. 7 is a detail of FIG. 6 and taken along section line 7—7 of FIGS. 3 and 4.

Figure 1:
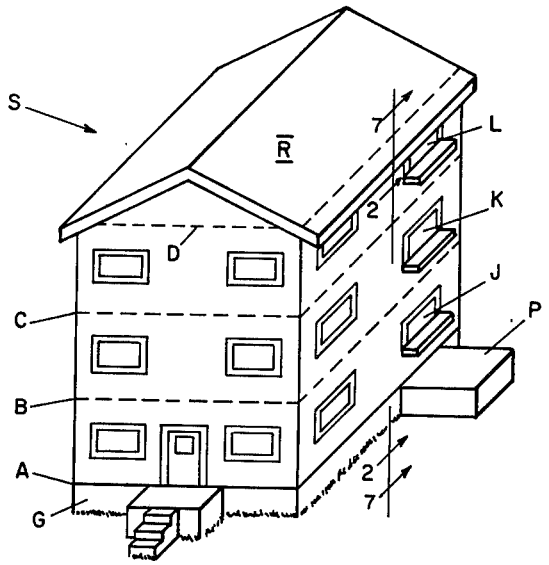
FIG. 1 is a perspective view of a typical multistory building structure "S", with which embodiments of the novel hydraulically actuatable system and normally closed emergency-hose might be employed.

The typical multistories building structure "S" of FIG. 1 comprises three horizontal floor levels A, B, and C. D indicates the ceiling level for the third story, and R defines an attic atop the third story. The foundation for structure S includes a concrete slab G as an apron or patio P. Structure S might have one or more windows such as windows J, K, and L in vertical alignment with patio P. A finite vertical-distance V exists between the adjacent floor levels.

Referring initially to FIGS. 2-5, the typical elevator embodiment M of the novel hydraulically actuatable elevator system might be disposed within lofty wellway W, provided within building structure S by cutting a rectangular opening through each floor. Embodiment M is arbitrarily selected as a "two stories" elevator system.

Elevator system M comprises a substantially horizontal weighty carrier member for passengers located within wellway W. Herein, the carrier 10 has a loadable deck platform 11, a roof 14 and opposed sidewalls 12. Elevator car 10 might also have passenger ingress/egress sliding-doors 15 between sidewalls 12. Sidewalls 12 are preferably vertically grooved as at 13 to accommodate therealong vertical track guide means e.g. columnar rails 30, car 10 at grooved portions 13 herein including rollers 16 to minimize friction between the car and the track means. A tongue-like extension 11A of deck 11 into region 31 provides the lower extremities of sidewall grooves 13.

Elevator system M also comprises a superstructure disposed loftily above the arbitrarily selected upper floor level B, and from which superstructure the carrier is suspended with at least one intervening hydraulically-actuatable piston (e.g. 50). The superstructure (e.g. 20) has a fixed relationship to building structure S, as herein disposed loftily above the upper arbitrarily selected floor level B. The superstructure e.g. 20, maintained in lofty fixed elevation above a shaftway e.g. W, for a vertically reciprocatable carrier member e.g. 10, provides a lofty frame member for the elevator system.

There are vertically extending track means (e.g. 30) for vertically guiding the carrier member (e.g. 10), said track means herein comprising a pair of lofty upright stationary columnar rails 30 transversely spaced apart in substantial parallelism within wellway W. The elongate interior side 31 of each said columnar rail 30 faces intervening elevator car 10 and is aptly disposed within grooved portion 13. The upper portions 33 of rails 30 are rigidly tied together with transverse header 21, thus providing superstructure 20. As indicated in FIG. 4, rails 30 might be additionally tied together with a horizontal rectangularly-annular structure 35. Attached to the lower ends of rails 30 are baseplates 32 restable upon concrete substrate G. Thus, annulus 35 and header 21 rigidly join rails 30 to provide a lofty self-sustaining frame member which is modularly portable. This modular portable form can be employed either within a lofty wellway W located internally of building S, or externally thereof as on patio P to service window elevations J, K, and L.

An exceedingly important aspect of this invention concerns the use of at least one hydraulically-actuatable piston of the casing-plunger segments type for suspending the carrier member (e.g. 10, 11) from the lofty superstructure. Forceable introduction of hydraulic fluid into the suspended piston shortens the piston overall longitudinal length causing the carrier member to ascend, and emission of hydraulic fluid from the piston allows lengthening of the piston and the carrier member descends. Normally the piston plunger (e.g. 62) is suspendably attached from the lofty superstructure (e.g. 20), and the piston casing (e.g. 52) is upright and co-movably attached to the carrier member (10). An appropriate pump means (e.g. 100), is adapted to forceably introduce hydraulic fluid from a reservoir 101 into the casing interior 56 to shorten the overall piston height causing the carrier member to ascend. For reasons to be explained later in greater detail, pump means 100 and reservoir 101 are co-movably mounted to the carrier member 10, in preference to mounting the pump and reservoir to the superstructure (e.g. 20), as within chest 120 attached atop car (14).

Piston 50, which extends along vertical longitudinal axis 51, comprises an upright elongate tubular casing segment 52 circularly annularly surrounding axis 51 and having a rearward end wall 53 and a centrally open forward end wall 54 thereabove. Casing 52 has a sideward orifice 49 for the introduction and emission of hydraulic fluids for casing compartment 56. Piston plunger 62 lies at a fixed elevation and extends along axis 51, as by suspendably attaching plunger forward end 64 to the lofty superstructure (e.g. header 21). The plunger rearward end takes the form of a solid circular shoulder 63 slidably engaging the entire elongate circular wall 55 of casing 52 below orifice 49. The centrally open casing forward end wall 54 slidably surrounds the narrowed preponderant length 69 of plunger 62. Thus, casing 52 is vertically reciprocatably slidable along stationary plunger 62, the maximum longitudinal forward extendability of plunger 62 relative to casing 52 occurring when shoulder 63 is immediately rearwardly of orifice 49 and forward end wall 54. This extendability should at least equal the value V. Thus, there exists between plunger shoulder 63 and casing forward orifice 49 a longitudinally dimensionally variable fluid compartment 56 within the forward portion of casing 52 commencing at substantially casing forward end wall 54 and extending rearwardly to plunger rearward shoulder 63, an elongated condition of fluid compartment 56 existing when the piston (50) is shortened as indicated in phantom line in FIG. 2.

Figure 2:
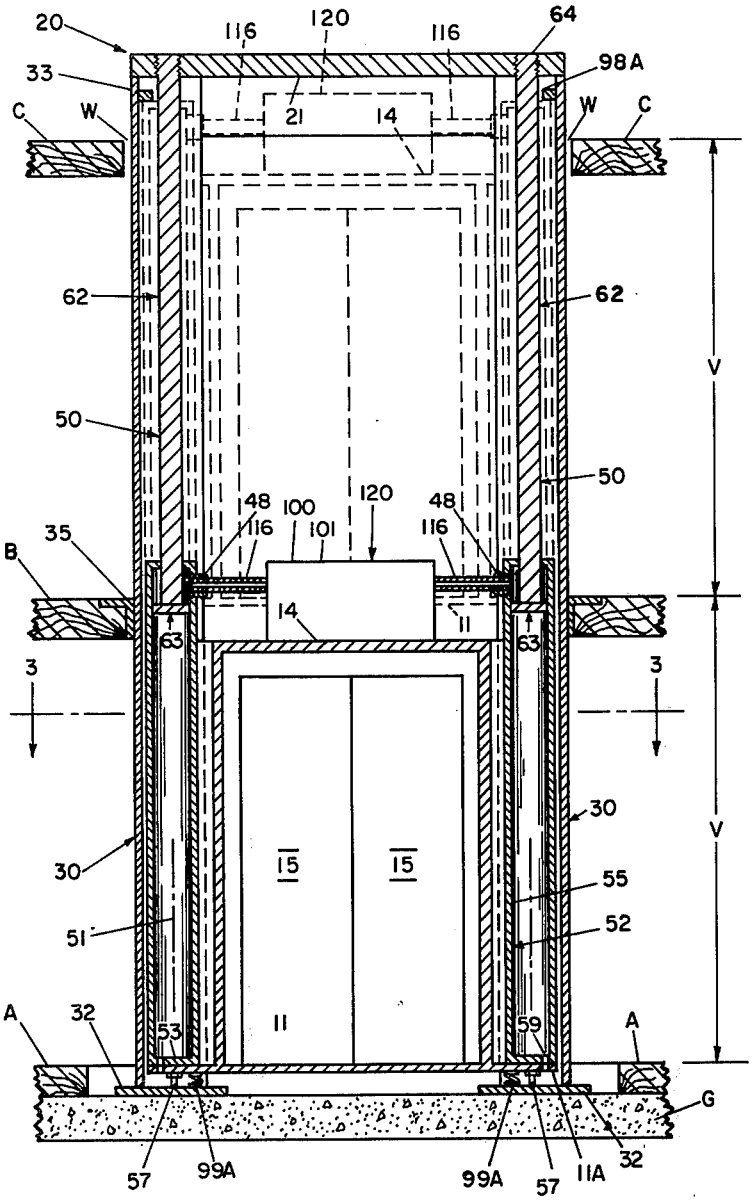
FIG. 2 is a sectional elevational view taken along line 2—2 of FIG. 1 showing an embodiment of the system herein employed within a lofty shaft-like wellway "W" located internally of building structure "S"

For the elevator embodiment M of FIGS. 2–4, two of the aforedescribed hydraulically actuatable pistons 50 are employed to suspend the elevator car carrier 10 from the lofty superstructure 20. The two pistons are structurally and dimensionally similar, the casing length 53–54 being generally comparable to rise distance "V". The two respective pistons 50 are herein uprightly disposed on opposite sides of car 10 within vertically grooved portions 13 and conveniently disposed within the upright interior side 31 of rails 30. The lower rearward end 53 of the respective piston casings 52 are of substantially co-elevation at the elevator car platform deck 11, as abutting horizontal extensions 11A. Attachment of casings 52 to car 10 at 11A is herein accomplished by ab integral stud 57 extending downwardly rearwardly of end walls 53, said stud 57 extending vertically through deck portions 11A and secured thereat with nuts 58. The threaded upper forward 64 of the respective piston plunger segments 62 are of substantial co-elevation at superstructure 20.

As indicated in FIGS. 2–6, and particularly in FIG. 4, the hydraulically-actuatable elevator system of the present invention is amenable to easy assembly and modular-like portability. For example, the entire assembly lends itself to modular insertion and installation into the internal wellway W of building S. Alternatively, the modular form can be readily installed onto a patio-like substrate P located externally of building S to service window elevations J, K, and L.

There are control means positioned between the pump means 100 and the at least one hydraulically-actuatable piston (50) so that the elevator car 10–11 is vertically movable between floor levels, one such control means being schematically illustrated in FIG. 6. There is a primary-line "PL" communicating from the reservoir tank 101 through the pump means 100 and into the casing interior 49 through hosing 116. Bypassing the pump means 100 is a secondary-line "SL" communicating from the casing interior 49 via hosing 116 and into the reservoir 101. Secondary-line "SL" includes an electrically governable checkvalve 106, herein of the solenoid pilot-to-open type. Schematically shown are electric wires 118 and 119 for powering said checkvalve 106, flow control 104, and a pressure compensated, variable volume, electrically driven hydraulic fluid pump 100. Interposed between pump 100 and hosing 116 along primary-line "PL" are standard checking-valves 102 and 103. Along secondary-line "SL" between hosing 116 and checkvalve 106 is another checking-valve 105. Tying the primary-line and the secondary-line is a variable volume, pressure compensated, electrically adjustable flow control valve 104.

Accordingly, when a signal is given (through conventional elevator electrical control circuitry) for the car 10 to rise, pump 100 starts, drawing fluid from reservoir tank 101 along primary-line "PL", creating a positive pressure at the 102–104 confluence. At the outset of pump operation, flow control 104 is in the zero flow position. An electric motor (not shown) connected to flow control 104 opens same over a period of a few seconds to allow the flow rate to gradually increase from zero to a preset maximum, thus allowing smooth acceleration of car 10 to full upwards velocity. Hydraulic fluid flow during car ascension will be from tank 101 through pump 100, checking valve 102, flow control 104, and checking-valve 105 into the piston casing 52 causing the overall length of piston 50 to shorten. Inasmuch as car 10 is attached to casing 52, the said car 10 will ascend.

Upon receiving a signal for the car 10 to cease ascending, the electric motor for flow control 104 will move same towards the closed position over a few seconds time, thus gradually slowing the car ascension rate until the flow control 104 is at zero flow and car 10 stopped, whereupon pump 100 is shut-off. While car 10 remains stopped, hydraulic fluid remains trapped in piston casing 52 under high static pressure by a combination of checkvalve 106, checking-valve 105, and flow control 104 (set at zero flow). Thus, an unprogrammed descent of car 10 would require simultaneous failure of either flow control 104 or checking-valve 105 and checkvalve 106.

When a signal is given for car 10 to descend, solenoid pilot-to-open checkvalve 106 opens and the electric motor for flow control 104 opens same to a preset maximum flow rate over a period of a few seconds time, and allowing car 10 to gradually accelerate to maximum downward velocity. The hydraulic fluid flows from piston casing 52 to tank 101 through flow control 104, checking-valve 103, and checkvalve 106. Upon receiving a signal to stop downward travel of car 10, flow control 104 is driven towards the closed position over a period of a few seconds time, thus gradually slowing the car to a full stop. When flow control 104 has returned to the zero flow position, checkvalve 106 is electrically de-energized, checking further flow.

It can be readily appreciated from the three immediately preceeding paragraphs that in the contingency of electrical power failure, the solenoid pilot-to-open checkvalve 106 is inoperative and hydraulic fluid could not flow along secondary-line "SL". In such a contingency the elevator car passengers might find themselves trapped between floors without practical egress. To remedy such possible occurrence, there is shown in broken line in FIG. 6 the addition of an emergency-line "EL" communicating from the piston casing interior 49 to the reservoir 101, but bypassing the flow control 104, the pump means 100 and the checkvalve 106. Emergency-line "EL" has a normally-closed barrier therealong, such as manual two-way valve 107, and herein also shown a fixed flow control valve 108. Manipulation of valve 107 by a passenger or by servicing personnel would allow the weighty car 10 to descend to a convenient passenger egress level in the contingency of electrical power failure to various components, inter alia checkvalve 106.

Ready access to the manual two-way valve 107 by a car passenger is desireable, such as by positioning said valve 107 in a co-movable relationship to car 10. For example, the chest-like housing 120 for elements 100–108 can be co-movably attached upon car roof 14, as alluded to in FIGS. 2, 4, 6, and 7. Moreover, car roof 14 might have a downwardly pivotal trapdoor 14T positioned immediately below the chest 120 so that a passenger might gain access to manual valve 107. However, the said guarding means 14T for the manual valve 107 should be made of a type to dissuade pranksters and vandals from tampering with said manual valve 107.

In order to prevent passenger access to the manual valve barrier means 107, except in the case of a bona fide electrical power failure, the guard means e.g. 14T is preferably automatically withdrawn from guarding said valve 107 whenever electrical power in fact becomes suddenly unavailable to checkvalve 106. For example, as indicated in FIG. 7, the guarding means 14T might include a guard latch 14L removably secured to an electrical solenoid assembly 110 and which latch 14L automatically disengages therefrom whenever there is an electrical power failure. Solenoid assembly 110 is attached upon car roof 14 aside of trapdoor 14T and includes armature 113 surrounded by electrically powered 118–119 windings 111. Horizontally reciprocatable armature 113 includes a rear-end 115 and a fore-end 114 which is electromagnetically forceably extended through centrally-open latch 14L so long as electrical power 118–119 is supplied to the system, inter alia windings 111, flow control 104, checkvalve 106, etc. Integrally upstanding from car roof 14 rearwardly of windings 111 and armature rear-end 115 is a peg 115W, and a helical spring 117 is attached in tension between peg 115W and armature rear-end 115. Two-way valve 107 is manually actuatable with a flexible lanyard 107L hanging loosely from valve 107 and carrying a manually graspable ball 107M on the lower free end. Upon sudden electrical power failure to the system, windings 111 become de-energized and spring 117 is allowed to retract, pulling armature fore-end 114 from trapdoor latch 14L, whereupon trapdoor 14T pivots downwardly from car roof 14 as indicated in phantom line in FIG. 7. When this happens, flexible lanyard 107L, which had heretofore been sinuously supported by horizontal trapdoor 14T, falls downwardly into the elevator car 10 passenger compartment, as indicated in FIG. 7 phantom line. Thus, a car passenger can pull downwardly upon the lanyard endward weighty ball 107M to actuate valve 107 to the "on" position. When this happens, hydraulic fluid flows through valve 108 along emergency-line "EL" and thence through valve 107 into reservoir tank 101, and piston 50 is allowed to lengthen whereby car 10 descends to a lower, passenger egress level. Upon resumption of the power 118–119, the valve 107 is manipulated to the "off" position, and the elevator control system is operational as before the emergency descent "EL".

From the foregoing, the construction and operation of the hydraulically-actuatable elevator system will be readily understood and further explanation is believed to be unnecessary. However, since numerous modifications and changes will readily occur to those skilled in the art, it is not desired to limit the invention to the exact construction shown and described, and accordingly, all suitable modifications and equivalents may be resorted to, falling within the scope of the appended claims.

I claim:

1. A hydraulically-actuatable elevator system for use in combination with a multi-stories building structure and including a lofty vertical shaft-like wellway, said elevator system comprising:

A. A weighty carrier member having a horizontal lower platform and uprightly therefrom structured to define an internal passenger compartment therefor, said carrier member being disposed within said wellway and vertically reciprocatable along a track means guide attached to the building structure;

B. At least one elongate hydraulically-actuatable piston of the dual-segments plunger/casing type suspending the carrier member from a stationary superstructure within said wellway, the upright elongate casing segment being co-movably rigidly attached to the carrier;

C. Pump means for hydraulic fluid and including a fluid reservoir means, said pump means communicating through a primary-line into the piston casing whereby controlled introduction of hydraulic fluid into the piston casing with respect to its stationary suspended associated plunger causes the carrier member to ascend;

D. A secondary-line extending from the piston's casing interior to the reservoir and bypassing the pump means and having electrically governable checkvalve therealong and with the result that controlled withdrawal of hydraulic fluid from the piston's casing to a reservoir through the secondary-line allows the weighty carrier member to descend; and E. An emergency-line extending from the piston casing interior to a reservoir and bypassing the pump means and the electrically governable checkvalve, said emergency-line being co-movably attached to the carrier member and having therealong a normally-closed valve barrier of the on-off type, there also being co-movably associated with the carrier member and accessible within the internal passenger compartment a non-electrical manual opening means for the normally-closed barrier to permit hydraulic fluid to flow along the emergency-line into a fluid reservoir to allow the weighty carrier to descend and initiated by the passenger in the contingency that electrical power for ultimately governing the secondary-line checkvalve suddenly becomes unavailable.

2. The elevator system of claim 1 wherein the carrier member structure also includes a guard means interposed between the carrier internal passenger compartment and guarding the valve manual wielding means, said guard means being automatically withdrawn whenever electrical power becomes suddenly unavailable to the secondary-line checkvalve.

3. The elevator system of claim 2 wherein there are withdrawing means for the guard means comprising a guard latch secured to an electrical solenoid arrangement and which latch automatically disengages therefrom whenever there is an electrical power failure.

4. The elevator system of claim 3 wherein the carrier comprises a roof overlying the passenger compartment, the valve wielding means and the electrical solenoid being attached to and located on the roof upperside; and wherein the carrier roof is provided with a downwardly pivotal roof as a guard means for the valve wielding means thereabove, the guarding door having a latch disengageably attached to the solenoid.

5. The elevator system of claim 4 wherein a spring means is biased against the solenoid armature and tending to disengage said armature from the guarding door latch; and wherein the normally-closed barrier valve overlies the downwardly pivotal guarding door by a finite-space and has a flexible lanyard wielding means having a length greatly exceeding said finite-spacing and resting downwardly against said latched guarding door whereby the lanyard drops down into the carrier passenger compartment upon disengagement of the door from the latched connection to the solenoid.

6. A modular hydraulically-actuatable elevator system including a vertically reciprocatable elevator car carrier member having a substantially horizontal loadable deck platform and upright structuring therefrom to define an internal passenger compartment for said carrier and adapted to reciprocate between elevations, said modular elevator system comprising:

A. An upright lofty portable frame member having a lower portion adapted to stably support the frame directly upon a substantially horizontal substrate and having an upper portion disposed loftily thereabove, the frame including lofty upright dual rails type track means for guiding the vertically reciprocatable carrier member;

B. At least one hydraulically-actuatable upright piston of the dual-segments piston/casing type for suspending the carrier from the frame member upper portion, the plunger segment being suspended from the frame member upper portion and the upright casing segment being co-movably attached to the carrier member;

C. Electrical pump means for hydraulic fluid and a fluid reservoir both attached in co-movable relationship to the carrier member, said pump means communicating through a primary-line into the piston casing whereby controlled introduction of hydraulic fluid into the casing will upwardly retract the casing with respect to its stationary suspended associated plunger causing the carrier member to ascend to a desired level;

D. A secondary-line extending from the casing interior to the reservoir and bypassing the pump means and having an electrically governable checkvalve therealong, whereby controlled withdrawal of hydraulic fluid from the piston casing through the secondary-line causes an overally lengthening of the piston to allow the weighty carrier member to descend; and E. An emergency-line communicating with the casing interior to the reservoir and bypassing the pump means and the checkvalve of the secondary-line, said emergency-line being co-movably attached to the carrier member and including a normally-closed fluid barrier therealong of the on-off valve type, there being accessible within the internal passenger compartment manually wieldable non-electrical opening means for said normally-closed barrier to permit hydraulic fluid to flow along the emergency-line into the reservoir, thereby allowing the weighty carrier member to descend and initiated by a passenger in the contingency that electrical power for governing the secondary-line checkvalve suddenly becomes unavailable.

7. The elevator system of claim 6 wherein the carrier member structure includes a guard means interposed between the carrier internal passenger compartment and guarding the valve manual wielding means, said guard means being automatically withdrawn whenever electrical power becomes suddenly unavailable to the secondary-line checkvalve.

8. The elevator system of claim 7 wherein the carrier includes a roof overlying the passenger compartment, the carrier roof being provided with a downwardly pivotal door having a latch as a door guard for the valve wielding means; and wherein the normally-closed barrier valve is co-movably attached to the carrier and located on the roof upperside.

9. The elevator system of claim 8 wherein the door guard automatic withdrawing means comprises a solenoid disengageably associated with the door latch; and wherein the normally-closed valve is manually wieldable with a lanyard that emergences into the carrier as the door guard is automatically withdrawn during electrical power failure.

* * * * *